US005605098A

United States Patent [19]

Wadlinger

[11] Patent Number: 5,605,098

[45] Date of Patent: Feb. 25, 1997

[54] GRIPPERS FOR SHEET-FED PRINTING PRESSES

[75] Inventor: Ralf Wadlinger, Ludwigshafen, Germany

[73] Assignee: Heidelberger Druckmaschinen AG, Heidelberg, Germany

[21] Appl. No.: 532,170

[22] Filed: Sep. 22, 1995

[30] Foreign Application Priority Data

Sep. 24, 1994 [DE] Germany ..... 44 34 151.2

[51] Int. Cl.[6] ..... B41F 1/30

[52] U.S. Cl. ..... 101/415.1; 101/409

[58] Field of Search ..... 101/415.1, 409; 271/277

[56] References Cited

U.S. PATENT DOCUMENTS

| | | | |
|---|---|---|---|
| 2,195,491 | 4/1940 | Marchev | 101/415.1 |
| 3,332,345 | 7/1967 | Smyth | 101/409 |
| 3,924,849 | 12/1975 | Murakami | 271/277 |
| 4,846,061 | 7/1989 | Jeschke et al. | 101/409 |
| 5,199,757 | 4/1993 | Simeth | 271/277 |
| 5,303,650 | 4/1994 | Wieland | 101/409 |

*Primary Examiner*—Edgar S. Burr
*Assistant Examiner*—Daniel J. Colilla
*Attorney, Agent, or Firm*—Herbert L. Lerner; Laurence A. Greenberg

[57] ABSTRACT

Grippers for sheet-fed printing presses having gripper seats arranged on a gripper bar housing, gripper finger supports with gripper fingers swivellably carried by a gripper shaft adjacent the gripper bar housing, a drive acting via the gripper shaft, springy elements for determining a closing force of the grippers, and entrainer pins carried by the gripper shaft and engaging in slots formed in the gripper finger supports.

7 Claims, 2 Drawing Sheets

GRIPPERS FOR SHEET-FED PRINTING PRESSES

BACKGROUND OF THE INVENTION

1. Field of the Invention

The invention relates to grippers for sheet-fed printing presses and, more particularly, to such grippers having gripper seats arranged on a gripper bar housing, gripper finger supports with gripper fingers swivellably carried by a gripper shaft, a drive acting via the gripper shaft, and springy elements for determining a closing force of the grippers.

2. Description of Related Art including information disclosed under 37 CFR 1.92 to 1.99

Such grippers have become known heretofore for transporting sheets through the entire sheet-fed printing press. In this regard, the sheets are gripped at a leading edge thereof by a plurality of the grippers and are transferred from one to a next gripper bar. The drums for sheet transport, the impression cylinder and the delivery are provided with such gripper bars.

From the spare parts manual of the Heidelberg Speedmaster, grippers have become known with which entrainers are fastened to the gripper shaft, and springs are clamped between the entrainers and the gripper finger supports. The closing force is produced by these springs. The entrainers are constructed so as to surround the gripper shaft flange-like. The components which are used are quite costly, the installation thereof requiring a considerable assembly expense due to the great number thereof.

SUMMARY OF THE INVENTION

It is accordingly an object of the invention to provide grippers for sheet-fed printing presses which are of simpler and more economical construction than those of similar type known heretofore.

With the foregoing and other objects in view, there is provided, in accordance with the invention, grippers for sheet-fed printing presses having gripper seats arranged on a gripper bar housing, gripper finger supports with gripper fingers swivellably carried by a gripper shaft adjacent the gripper bar housing, a drive acting via the gripper shaft, and springy elements for determining a closing force of the grippers, comprising entrainer pins carried by the gripper shaft and engaging in slots formed in the gripper finger supports.

In accordance with another feature of the invention, the grippers include stop screws for the entrainer pins provided in the gripper finger supports, the stop screws being actuatable for individually adjusting the entrainment by the gripper shaft for each of the gripper finger supports.

In accordance with a further feature of the invention, the springy elements are the gripper fingers.

In accordance with an added feature of the invention, each of the gripper finger supports is pressable by one of the springy elements in closing direction.

In accordance with an additional feature of the invention, the springy elements are spring clips which are braced against the gripper bar housing and the gripper finger supports.

In accordance with a concomitant feature of the invention, the springy elements are braced against the gripper shaft and the gripper finger supports.

An advantage of the invention is that costly entrainers can be replaced by considerably lower-priced entrainer pins. Costs, as well as construction space, are thereby reduced. Assembly expense is also markedly minimized.

As noted hereinbefore, stop screws for the entrainer pins are provided in the gripper finger supports and serve for individually adjusting the entrainment by the gripper shaft for each of the gripper finger supports. It is thereby possible to adjust the the entire gripper bar in a relatively simple manner, and to achieve thereby an exact clamping or gripping of the sheets with optimum holding forces.

The gripper fingers themselves may serve as the springy or resilient elements for generating the closing force, or the gripper finger supports can be pressed in the closing direction by springy elements other than the gripper fingers themselves. The springy elements may be formed as spring clips which are braced against the gripper bar housing and the gripper finger supports. It is also possible, however, that the springy elements are braced against the gripper shaft and the gripper finger supports. In the latter case, the spring force must be absorbed by the gripper shaft, a result thereof being, for example, that a gripper opening lever is pressed or forcibly guided via a separate spring into the end position.

Other features which are considered as characteristic for the invention are set forth in the appended claims.

Although the invention is illustrated and described herein as embodied in grippers for a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
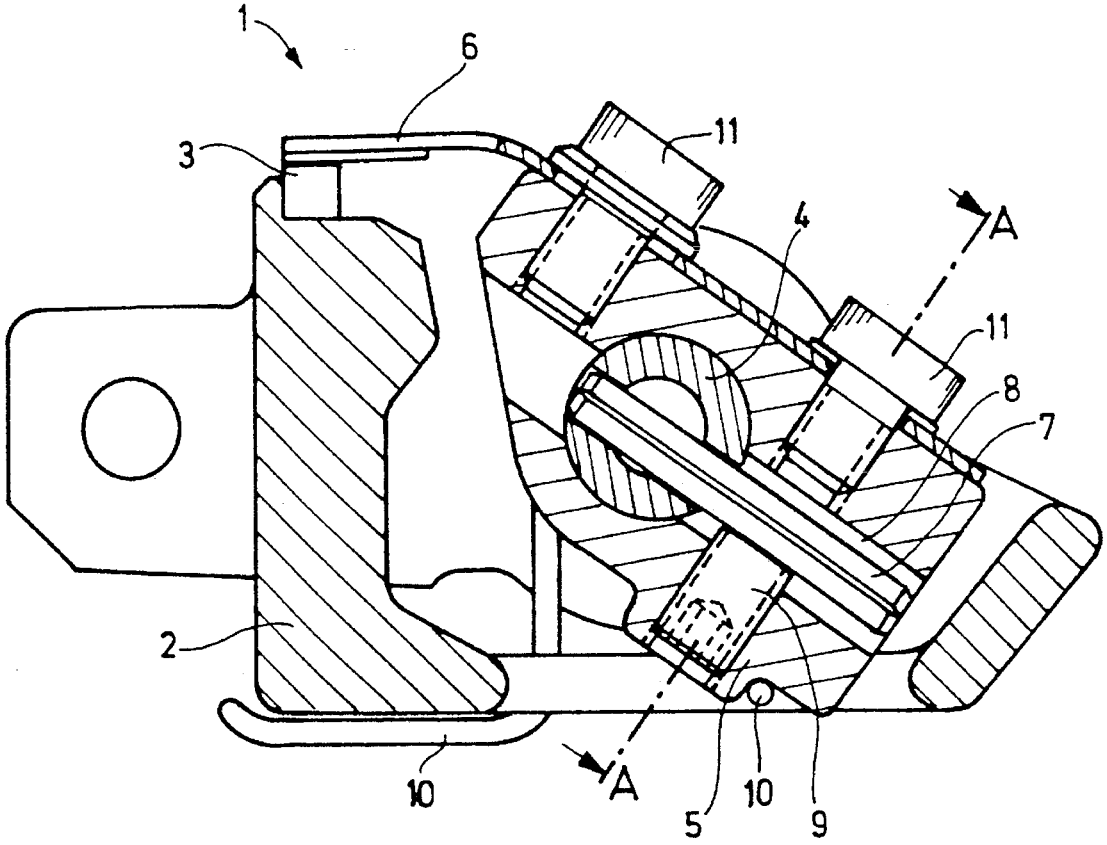
FIG. 1 is a cross-sectional view of a gripper bar and a gripper according to the invention.

Referring now to the drawing and, first, particularly to FIG. 1 thereof, there is shown therein in cross section a gripper bar in a cross-sectional plane located in the vicinity of grippers 1. The gripper bar has a housing 2 which carries respective gripper seats or gripper pads 3 which are engageable by gripper fingers 6 so as to clamp therebetween sheets which are guided through the printing press for the purpose of transporting them. For this purpose, the gripper bar must have a length which corresponds at least to the width or breadth of the paper sheets being printed on the respective press. A plurality of the grippers 1 are arranged on the gripper bar so as to ensure reliable clamping or gripping of the sheets. In the embodiment of the invention shown in FIG. 1, the gripper fingers 6 are formed of metal plates or sheets and are fastened by fastening screws or setscrews 11 to gripper finger supports 5. The gripper finger supports 5 are slid onto a gripper shaft 4 and are formed with such a seat thereon that they are free of play yet swivellable about the gripper shaft 4. For each pair of grippers 1, the gripper shaft 4 carries an entrainer pin 7 which engages in slots 8 formed in the gripper finger carrier 5 and, in this manner, fixes the gripper finger carrier 5 against movement in axial direction on the gripper shaft 4. In rotary direction, the entrainer pins 7 have play or clearance in the slots 8, so that a given no-load or idle stroke occurs. Setscrews or stop screws 9 are screwed into the gripper finger supports 5 in such a manner that the screws 9 engage in the slots 8. By suitably screwing the stop screws 9 in or out, an adjustment may be effected wherein all of the gripper finger supports 5 are simultaneously and in a correct position entrained by the entrainer pins 7 and thereby operated in the opening direction. A drive is arranged at the gripper shaft 4 and serves for operating the grippers 1. The closing force is applied by respective spring clips 10 assigned to respective pairs of grippers 1. The respective spring clips 10 are braced by one end thereof against the gripper bar housing 2 and by the other end thereof against the respective gripper finger carriers 5, the grippers 1 being thereby subjected to loading into the closing position.

Figure 2:
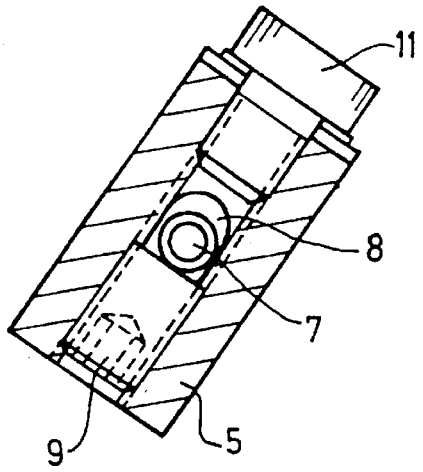
FIG. 2 is a sectional view of FIG. 1 taken along the line A—A in the direction of the arrows and showing a gripper finger support.

From the sectional view of FIG. 2, it is readily apparent how the entrainer pin 7 is mounted in the slot 8 and how the instant of time at which entrainment occurs can be adjusted by the stop screw 9.

Figure 3:
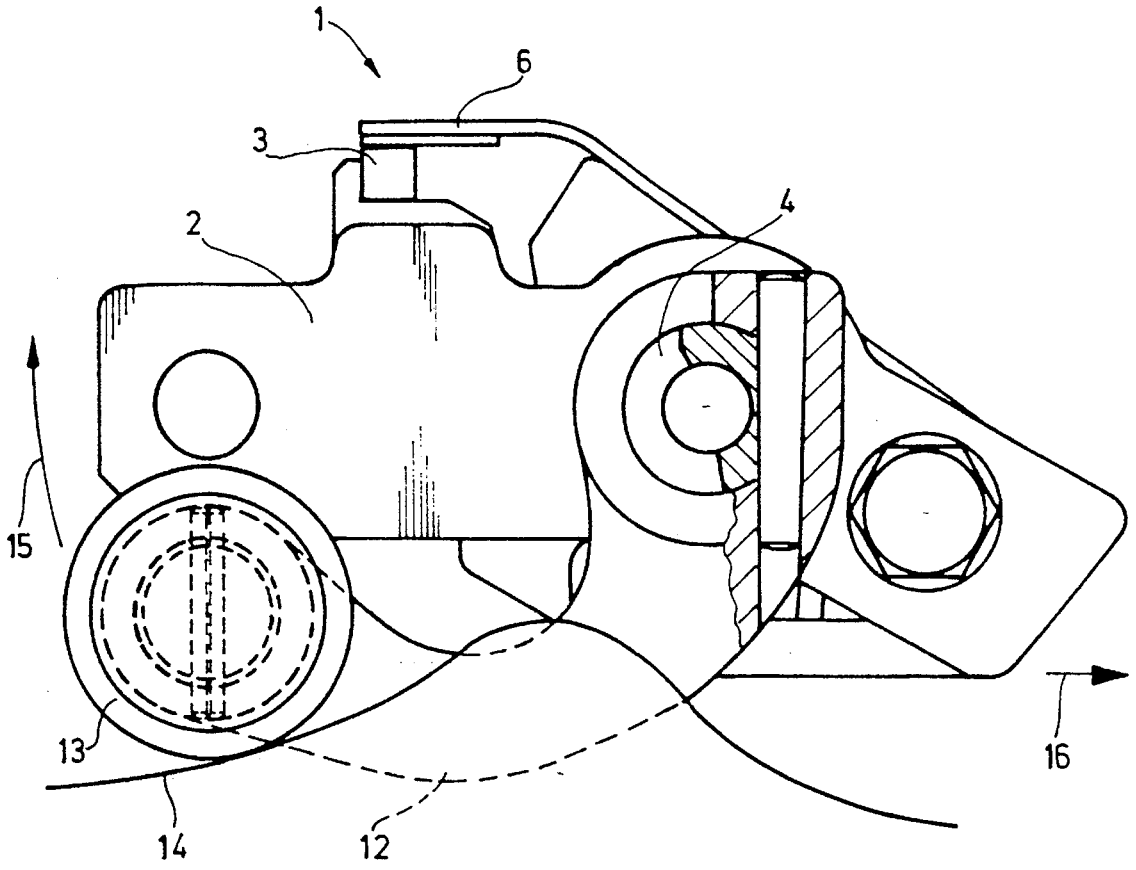
FIG. 3 is an end view of FIG. 1, partly in section, and showing a drive for the grippers of the gripper bar.

FIG. 3 shows the drive of the grippers 1 of the gripper bar. A gripper opening lever 12 is disposed at one end of the gripper shaft 4 and, by means of a roller 13, runs on a gripper opening cam 14. The roller 13 can be pressed by spring force against the gripper opening cam 14 or a suitable cam is arranged above the roller 13 so as to forcibly guide the latter. The gripper opening cam 14 may be formed as a closed cam if the gripper bar is arranged on a drum or a cylinder. If the gripper bar is disposed in a delivery, the gripper opening cam 14 can extend also along a chain guide. In any event, the arrow 16 represents the direction in which the gripper bar runs, the roller 13 with the gripper opening lever 12 being pressed in the direction of the arrow 15 due to the illustrated rise of the gripper opening cam 14, and the gripper shaft 4 is thereby turned or rotated so as to open the grippers 1. Of course, it is also conceivable, to provide other ways for driving the gripper shaft 4 which are within the scope of the invention.

I claim:

1. Grippers for sheet-fed printing presses, comprising: a gripper shaft, a gripper bar housing gripper seats arranged on said gripper bar housing, and gripper finger supports with gripper fingers, the gripper finger supports being swivellable relative to and carried by said gripper shaft, said gripper finger supports having slots formed therein, a drive acting via the gripper shaft, springy elements for determining a closing force of the grippers, entrainer pins directly carried by the gripper shaft and positioned in the slots formed in the gripper finger supports, and stop screws supported in the gripper finger support and projecting into the slots, the stop screws abutting against the entrainer pins for adjusting the gripper finger support, and the slots providing clearance for the entrainer pins to allow movement thereof relative to said gripper finger support.

2. Grippers according to claim 1, wherein said stop screws are actuatable for individually adjusting the entrainment by the gripper shaft for each of the gripper finger supports.

3. Grippers according to claim 1, wherein the springy elements form a part of the gripper fingers.

4. Grippers according to claim 1, wherein each of the gripper finger supports is pressable by one of the springy elements in closing direction.

5. Grippers according to claim 4, wherein the springy elements are spring clips which are braced against the gripper bar housing and the gripper finger supports.

6. Grippers according to claim 4, wherein the springy elements are braced against the gripper shaft and the gripper finger supports.

7. Grippers for sheet-fed printing presses, comprising:

a gripper bar housing and gripper seats disposed on said gripper bar housing, a gripper shaft adjacent said gripper bar housing;

gripper finger supports with gripper fingers swivellably supported on said gripper shaft for rotation relative to said gripper shaft, said gripper finger supports having slots formed therein;

entrainer pins directly carried by said gripper shaft, said entrainer pins projecting radially from said gripper shaft and projecting into said slots formed in said gripper finger supports;

said entrainer pins being movable within said slots to allow movement of said entrainer pins relative to said gripper finger support.

* * * * *